US010786998B2

(12) United States Patent
Tokimatsu

(10) Patent No.: US 10,786,998 B2
(45) Date of Patent: Sep. 29, 2020

(54) INKJET RECORDING DEVICE HAVING CONTROLLER FOR BUBBLE DISCHARGING OPERATION

(71) Applicant: Konica Minolta, Inc., Tokyo (JP)

(72) Inventor: Hiroyuki Tokimatsu, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/300,405

(22) PCT Filed: May 12, 2017

(86) PCT No.: PCT/JP2017/017969
§ 371 (c)(1),
(2) Date: Nov. 9, 2018

(87) PCT Pub. No.: WO2017/208776
PCT Pub. Date: Dec. 7, 2017

(65) Prior Publication Data

US 2019/0143709 A1 May 16, 2019

(30) Foreign Application Priority Data

Jun. 3, 2016 (JP) ..... 2016-111957

(51) Int. Cl.
*B41J 2/19* (2006.01)
*B41J 29/38* (2006.01)
(Continued)

(52) U.S. Cl.
CPC ..... *B41J 2/19* (2013.01); *B41J 2/16535* (2013.01); *B41J 2/16538* (2013.01);
(Continued)

(58) Field of Classification Search
CPC ..... B41J 2/19; B41J 2/16552; B41J 2/16585; B41J 2/18; B41J 2/16538; B41J 2/16535;
(Continued)

(56) References Cited

U.S. PATENT DOCUMENTS 7,908,996 B2 * 3/2011 Komatsu ..... B41J 2/04581 118/302
2004/0155915 A1 * 8/2004 Kitami ..... B41J 2/04581 347/10
2015/0035901 A1 * 2/2015 Obata ..... B41J 2/175 347/36

FOREIGN PATENT DOCUMENTS

CN 104220263 A 12/2014
EP 1905598 A2 4/2008
(Continued)

OTHER PUBLICATIONS

Written Opinion of the International Searching Authority dated Jul. 11, 2017 from the corresponding International Application No. PCT/JP2017/017969 and English translation.
(Continued)

*Primary Examiner* — Henok D Legesse
(74) *Attorney, Agent, or Firm* — Lucas & Mercanti, LLP

(57) ABSTRACT

There is provided an inkjet recording device including an inkjet head provided with a nozzle(s); an ink supplier which supplies ink to the inkjet head; a driver which performs a driving operation to cause pressure variation of ink; and a controller. The inkjet head includes: a common flow path in which supplied ink to the inkjet head flows; a filter provided in the common flow path; an individual flow path(s) respectively feeding ink having passed the filter to each of the nozzles; and a first discharge port from which ink in the common flow path is discharged. In a bubble discharging operation of ink, the controller causes the ink supplier to supply ink with a pressure which allows ink to leak out from
(Continued)

the nozzles, while causing the driver to perform a predetermined driving operation, so that ink is discharged from the first discharge port.

6 Claims, 6 Drawing Sheets

(51) Int. Cl.

| | |
|---|---|
| ***B41J 2/165*** | (2006.01) |
| ***B41J 2/18*** | (2006.01) |
| ***B41J 2/175*** | (2006.01) |
| *B41J 25/00* | (2006.01) |

(52) U.S. Cl.
CPC ..... *B41J 2/16552* (2013.01); *B41J 2/16585* (2013.01); *B41J 2/17563* (2013.01); *B41J 2/17596* (2013.01); *B41J 2/18* (2013.01); *B41J 29/38* (2013.01); *B41J 2002/1655* (2013.01); *B41J 2002/16558* (2013.01); *B41J 2025/008* (2013.01)

(58) Field of Classification Search
CPC .... B41J 29/38; B41J 2/17596; B41J 2/17563; B41J 2002/16558; B41J 2025/008; B41J 2002/1655
See application file for complete search history.

(56) References Cited

FOREIGN PATENT DOCUMENTS

| | | | |
|---|---|---|---|
| EP | 2826628 | A1 | 1/2015 |
| EP | 3000605 | A1 | 3/2016 |
| JP | 2015071231 | A | 4/2015 |

OTHER PUBLICATIONS

International Search Report dated Jul. 11, 2017 for PCT/JP2017/017969 and English translation.
EPO, Extended European Search Report for the corresponding European Patent Application No. 17806334.3, dated Jun. 17, 2019 (7 pages).
CNIPA, Office Action for the corresponding Chinese Patent Application No. 201780033829.3, dated Oct. 28, 2019, with English translation.

* cited by examiner

INKJET RECORDING DEVICE HAVING CONTROLLER FOR BUBBLE DISCHARGING OPERATION

CROSS REFERENCE TO RELATED APPLICATION

This Application is a 371 of PCT/JP2017/017969 filed on May 12, 2017 which, in turn, claimed the priority of Japanese Patent Application No. 2016-111957 filed on Jun. 3, 2016, both applications are incorporated herein by reference.

TECHNICAL FIELD

The present invention relates to an inkjet recording device.

BACKGROUND ART

There has been an inkjet recording device which records an image on a recording medium by ejecting ink from a nozzle and by landing the ink on the recording medium. In the inkjet recording device, ejection failure of ink from the nozzle results in deterioration of the recorded image. Therefore, there are various techniques for inspecting whether or not the ink is ejected in a proper state and performing a maintenance operation according to the inspection result.

An example of the main cause of the ejection failure of ink from the nozzle is contamination and air bubbles in the ink. In order to prevent contamination, a filter is conventionally provided in the ink flow path from an ink tank to each nozzle in the inkjet recording device. Further, for the purpose of discharging bubbles and the like, a technique is known in which a common flow path for feeding ink separately into individual flow paths communicating with a plurality of nozzles is provided so that the ink in the common flow path is circulated and returned to an ink tank. In such a technique, in a state where ink hardly leaks by causing a negative ink pressure in the nozzle, a driving operation is performed to cause minute vibrations at the liquid surface of the ink such that the ink is not ejected from the nozzle. By circulating the ink after the driving operation, bubbles in the individual flow paths and the nozzles are easily detached from the wall surfaces, so that air bubbles and foreign matter are removed (for example, Patent Document 1).

CITATION LIST

Patent Literature

[Patent Document 1] Japanese Patent Application Laid Open Publication No. 2015-071231

SUMMARY OF INVENTION

Technical Problem

However, in discharging the bubbles in the ink flow path, there is a problem that it is difficult and takes time to return the bubbles once entered into a thin individual flow path or a nozzle to the upstream side for discharging.

The object of the present invention is to provide an inkjet recording device which can more easily and reliably discharge bubbles in an ink flow path.

Solution to Problem

In order to achieve at least one of the above-described objects, according to one aspect of the invention, an inkjet recording device includes:

an inkjet head which is provided with one or more nozzles which perform ejection of ink;

an ink supplier which supplies ink to the inkjet head;

a driver which performs a driving operation to cause a pressure variation of ink in the nozzles regarding the ejection; and a controller which controls an operation of the ink supplier and an operation of the driver, wherein the inkjet head includes:

a common flow path in which supplied ink to the inkjet head flows;

a filter which is provided in the common flow path and through which supplied ink passes;

one or more individual flow paths which respectively feed ink having has passed through the filter from the common flow path to each of the nozzles; and a first discharge port from which ink having passed through the filter and being in the common flow path is discharged;

wherein, in a bubble discharging operation of ink in the inkjet head, the controller causes the ink supplier to supply ink with a pressure which allows ink to leak out from the nozzles while the controller causes the driver to perform a predetermined driving operation, so that ink is discharged from the first discharge port.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DESCRIPTION OF EMBODIMENTS

Hereinafter, one or more embodiments of the present invention will be described with reference to the drawings. However, the scope of the invention is not limited to the disclosed embodiments.

An embodiment of the present invention is described with reference to the diagrams.

Figure 1:
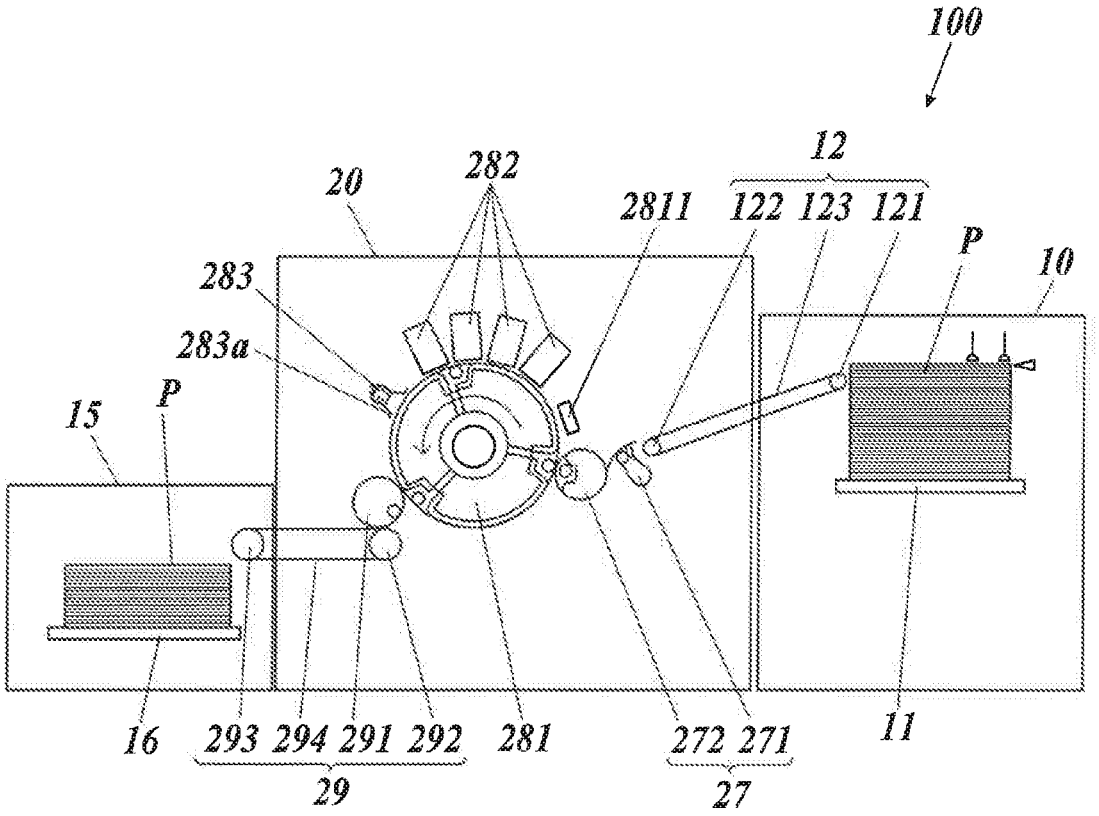
FIG. 1 is a schematic diagram showing configuration of an inkjet recording device.

FIG. 1 is a schematic diagram showing configuration of an inkjet recording device 100 of an embodiment of the present invention.

FIG. 1 indicates the inkjet recording device 100 when it is seen from the front.

The inkjet recording device 100 is a printer including a line head and employing a one-pass method in which a color image is formed by ejecting ink of four colors at appropriate timings while moving a recording medium relative to the line head.

The inkjet recording device 100 includes a medium supplier 10, a medium receiving unit 15, an image forming body 20, an ink supplier 30 (see FIG. 2), a controller 40 (see FIG. 4), and the like. In this inkjet recording device 100, on the basis of the control by the controller 40, the recording medium P stored in the medium supplier 10 is conveyed to the image forming body 20 and discharged to the medium receiving unit 15 after image formation.

The medium supplier 10 conveys the recording medium P stored inside to the image forming body 20 one by one.

As the recording medium P, various objects are used, such as printing paper of various thickness, cell, film, and cloth, which can be curved around and held on the outer periphery surface of the image forming drum 21.

The medium supplier 10 includes a paper feeding tray 11 which stores the recording medium P, a feeder board 12 which conveys the recording medium P from the paper feeding tray 11 to the image forming body section 20. The paper feeding tray 11 is a plate-like member which is made mountable for one or more recording medium P. The paper feeding tray 11 is provided to move vertically according to the amount of the recording medium P mounted on the paper feeding tray 11, and for the vertical move, the topmost of the recording medium P is kept in a position where it is able to be conveyed by the feeder board 12.

The feeder board 12 includes a conveyance mechanism which conveys the recording medium P on the belt 123 by driving the ring-shaped belt 123 which is held by a plurality of (for example, two) rollers 121 and 122 from inside, and a supplier which delivers the topmost recording medium P mounted on the paper feeding tray 11 to the belt 123. The feeder board 12 conveys along the belt 123 the recording medium P which has been delivered from the supplier to the belt 123.

The image forming body 20 includes a first delivery unit 27, an image forming drum 281, a head unit 282, an irradiator 283, and a second delivery unit 29, and the like.

The reception unit 27 receives a recording medium P from the medium supplier 10 and then conveys it to the image forming drum 281. The reception unit 27 includes a swing arm 271 which holds one end of the recording medium P conveyed on the feeding board 12 and a cylindrical reception drum 272 which conveys the recording medium P carried on the swing arm 271 to the image forming drum 281. The swing arm 271 receives the recording medium P on the feeding board 12 and then conveys it to the reception drum 272. This allows the reception unit 27 to guide the recording medium P along the outer periphery of the image forming drum 281 and then convey it to the image forming drum 281.

The image forming drum 281 has a cylindrical outer shape, carries three recording medium P at the maximum on the cylindrical outer peripheral surface, and carries out a conveyance operation of conveying the recording medium P according to the rotation around the central axis of the cylinder. Beside the outer peripheral surface of the image forming drum 281, a drum heater 2811 for heating the outer peripheral surface and the recording medium P is provided. Here, the drum heater 2811 is provided from the delivery position, where the first delivery unit 27 delivers the recording medium P to the image forming drum 281, to the image recording position, where the head unit 282 records an image on the recording medium P, on the rotation direction of the image forming drum 281. The duration and intensity of a heating operation by the drum heater 2811 are controlled so that the recording medium P to be held is at an appropriate temperature, on the basis of the temperature of the outer circumferential surface of the image forming drum 281 measured by a temperature measuring unit (not shown). As a result, an appropriate curing rate of the ink landed on the recording medium P is maintained, so that high quality images are stably formed. In the drum heater 2811, for example, an infrared heater or a heating wire that generates heat by energization is used. The drum heater 2811 may be provided inside of the image forming drum 281 and heat the outer peripheral surface by thermal conduction.

The head unit 282 ejects ink droplets toward one recording target surface of the recording medium P which moves according to the rotation of the image forming drum 281. The ink droplets are ejected at appropriate timings from a plurality of nozzle openings provided on a surface (nozzle surface) of the head unit 282 facing the recording target surface of the recording medium P, and landed on the recording target surface of the recording medium P. An image is thereby formed. The head unit 282 includes one or more inkjet heads 24 provided with a plurality of nozzles (see FIG. 2). In the inkjet recording device 100 according to the present embodiment, four head units 282 are arranged at predetermined intervals in the conveying direction of the recording medium P, each corresponding to inks of multiple colors, four in this case. The four head units 282 each eject inks of C (cyan), M (magenta), Y (yellow), and K (black). Here, inks cured by being irradiated with ultraviolet rays are used. Further, the inks are heated by an ink heater 2822 (see FIG. 4) inside and/or outside the head unit 282 so as to be maintained at an appropriate temperature.

Each of the head units 282 here has a plurality of nozzle openings arranged in the width direction, which is perpendicular to the conveying direction of the recording medium P conveyed on the image forming drum 281, over the width of image formation on the recording medium P. That is, each of the head units has a line head capable of forming an image by one-pass method by ejecting ink from the nozzle openings onto the recording medium P moving in the conveying direction. The head units 282 are each attached to a support portion (carriage) (not shown). By operating a motor and a brake for position adjustment via a unit position adjustment driver 58, the relative positions of the head units 282 with respect to the image forming drum 281, in particular, the distances from the outer peripheral surface of the image forming drum 281 to the head units 282, can be changed.

The irradiator 283 emits an energy ray (electromagnetic wave) of a predetermined wavelength, an ultraviolet ray in a near ultraviolet region of a wavelength of about 400 nm in this case, so that the ink (that is, an image formed by the ink) ejected from the head unit 282 and landed on the recording medium P is cured and fixed. The irradiator 283 has, for example, a light emitting diode (LED) for emitting ultraviolet rays. The LED emits ultraviolet rays when a current flows by voltage application to the LED in the driving operation of an irradiator driver 51 (see FIG. 4). The irradiator 283 is provided to irradiate the recording medium P conveyed by the rotation of the image forming drum 281 with ultraviolet rays, after the ink is ejected from the head unit 282 onto the recording medium P and before the recording medium P is delivered to the second delivery unit 29. In order to reduce the leakage of ultraviolet rays outside the setting range for ultraviolet irradiation in the recording medium P, the irradiator 283 has a light shielding plate 283*a* which covers the LED and the setting range.

The component for emitting ultraviolet rays in the irradiator 283 is not limited to an LED. The irradiator 283 may include, for example, a mercury lamp. If the ink has a property of being cured upon reception of energy rays other than ultraviolet rays, instead of the above-described component for emitting ultraviolet rays, a well-known light source which emits energy rays of a wavelength to cure the ink is provided.

The second delivery unit 29 conveys the recording medium P from the image forming drum 21 to the medium receiving unit 15 after formation of the image and curing of the landed ink. The second delivery unit 29 includes a cylindrical delivery roller 291, a plurality of (for example, two) rollers 292 and 293, and a circular belt 294 inside of which is supported by rollers 292 and 293. The delivery roller 291 guides the recording medium P from the image forming drum 281 onto the belt 294. After conveying the recording medium P from the delivery roller 291 onto the belt 294, which circles around the rollers 292 and 293 in accordance with the rotation thereof, the second delivery unit 29 moves the recording medium P on the belt 294 to the medium receiving unit 15.

The medium receiving unit 15 stores the recording medium P conveyed from the image forming body 20 via the second delivery unit 29 until a user picks it up. The medium receiving unit 15 has a plate-shaped copy receiving tray 16 on which the recording medium P is mounted after image formation.

The controller 40 controls operations of the medium supplier 10, the image forming body 20, the ink supplier 30, and the medium receiving unit 15, and forms an image on the recording medium P according to the data of the image to be formed by an image formation command (job) and settings regarding image formation.

Among the above configurations, a conveyance section is constituted by the medium supplier 10, the image forming drum 281 in the image forming body 20, the first delivery unit 27, the second delivery unit 29, and the medium receiving unit 15.

The ink supplier 30 stores ink of each color used for image recording and supplies the ink to the inkjet head 24. Each component of the ink supplier 30 is arranged in a dedicated rack or the like, and is connected to the image forming body 20 via a pipe such as a tube.

Next, the configuration relating to the flow of ink from the ink supplier 30 to the image forming body 20 in the inkjet recording device 100 of this embodiment will be described.

Figure 2:
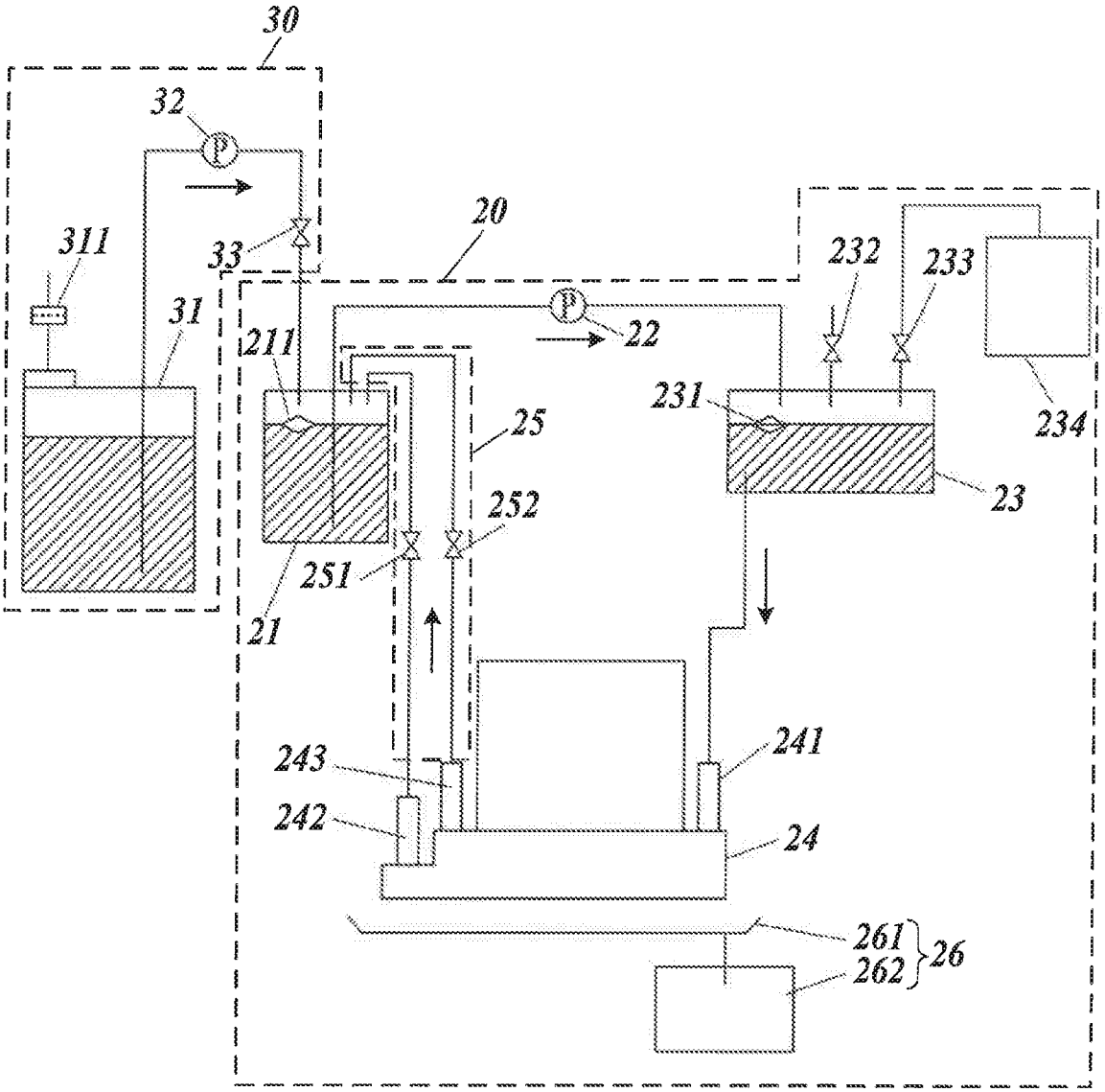
FIG. 2 is a diagram which describes configuration of an ink flow path of an inkjet recording device.

FIG. 2 is a diagram which describes a configuration of an ink flow path of the inkjet recording device 100 of the present embodiment.

The ink supplier 30 includes a main tank 31, a filter 311, a supplying pump 32, a supplying valve 33, and the like.

The ink in the main tank 31 is fed to the first sub tank 21 of the image forming body 20 via the supplying valve 33 by the operation of the supplying pump 32. The filter 311 prevents foreign substances and contaminants such as waste and dust from being mixed in the main tank 31 which is open to the atmosphere. The supplying valve 33 determines whether or not ink is supplied from the main tank 31 to the first sub tank 21. The supplying valve 33 is an electromagnetic valve which is opened and closed under the control operation of the controller 40, however, it may be possible to switch the opening and closing manually at the time of refilling the ink to the main tank 31, replacing the main tank 31, and the like. Further, the supplying valve 33 may be provided not in the ink supplier 30 but in the image forming body 20.

The image forming body 20 includes a first sub tank 21 (ink storage), a liquid feeding pump 22 (ink supplier), a second sub tank 23 (pressure adjuster), an inkjet head 24, a reflux unit 25, an ink discharge unit 26, and the like. They are provided for each of the multiple inks and for each of the multiple inkjet heads 24 forming a line head described above, and receive ink supplied from a common main tank 31 corresponding to the kind of the ink.

The ink supplied from the main tank 31 to the first sub tank 21 of the image forming body 20 by the supplying pump 32 is fed to the inkjet head 24. The ink which is not ejected or leaked from the inkjet head 24 is returned to the first sub tank 21 through the reflux unit 25.

Here, the first sub tank 21 is an ink tank having a smaller capacity than the main tank 31. The first sub tank 21 is provided with a first liquid level sensor 21 which detects the amount of ink in the first sub tank 21 and outputs a detected signal(s) to the controller 40 (see FIG. 4). The first liquid level sensor 211 may simply detect whether or not the ink amount is below the predetermined lowest reference value and output a detected signal(s) to the controller 40. The first sub tank 21 further stores the ink returned from the inkjet head 24. The operation of the supplying pump 32 is switched depending on the detected amount of the ink in the first sub tank 21, and the amount of ink in the first sub tank 21 is maintained appropriately.

The liquid feeding pump 22 feeds ink from the first sub tank 21 to the second sub tank 23. Conventionally well-known pumps can be used as the liquid feeding pump 22. When the second sub tank 23 is not communicated with the atmosphere or the air tank 234, the ink pressurized by the liquid feeding operation of the liquid feeding pump 22 is supplied to the inkjet head 24 via the second sub tank 23.

A second liquid level sensor 231 is provided in the second sub tank 23. The second liquid level sensor 231 performs the same operation as the first liquid level sensor 211 in the first sub tank 21, regarding the amount of the ink in the second sub tank 23.

The second sub tank 23 communicates with the atmosphere when the air releasing valve 232 is opened, and communicates with the air tank 234 when the air releasing valve 233 is opened. When the air releasing valve 233 is opened, the ink does not normally leak out from the nozzle because a pressure difference from the ink pressure on the nozzle face of the inkjet head 24 is caused due to the air pressure (negative pressure) in the air tank 234. When the pressure difference changes due to ejection of ink and the like, the ink pressure is adjusted so that ink corresponding to the pressure difference is supplied to the inkjet head 24. Alternatively, when the air releasing valves 232 and 233 are closed, ink which is pressurized according to the liquid feeding operation by the liquid feeding pump 22 is fed to the inkjet head 24 via the second sub tank 23, as described above.

The pressure in the air tank 234 may be adjustable as appropriate.

The inkjet head 24 allows ink to flow in from the inlet 241, distributes the ink to the individual flow paths 2471 (see FIG. 3) each communicating with the nozzles for ejecting ink, and allows ink that has not been ejected from the outlet 242 or 243 to flow out. The inlet 241 is connected to the second sub tank 23, and the outlets 242 and 243 are connected to the first sub tank 21 via the reflux unit 25. The reflux unit 25 includes an ink flow path(s) (circulation flow path(s)) which individually connects the outlets 242 and 243 with the first sub tank 21. A first reflux valve 251 (first discharge valve) and a second reflux valve 252 (second discharge valve) are provided in the respective circulation flow paths. Thereby the ink circulation availability (discharge ability) can be switched.

All of the air releasing valve 233, the first reflux valve 251, and the second reflux valve 252 are electromagnetic valves and are electromagnetically opened and closed on the basis of the control by the controller 40.

The ink receiving unit 26 receives ink in a maintenance operation and the like, where ink is ejected from the nozzle opening of the inkjet head 24 to a portion other than the recording medium or in an operation where ink leaks. An ink tray 261 is a tray for receiving ink from these nozzles. The waste liquid tank 262 stores the ink received by the ink tray 261. Although the ink stored in the waste liquid tank 262 is discarded here, it may be stored for each of the inks to be reused. Here, the ink tray 261 is configured to be movable to a position facing the nozzle openings in a state where the distance between the head unit 282 and the conveying surface is enlarged. Alternatively, the ink tray 261 may be provided at a predetermined maintenance position, and the head unit 282 may be moved as needed to arrange the nozzle surface of the inkjet head 24 at a position facing the ink tray 261.

Figure 3:
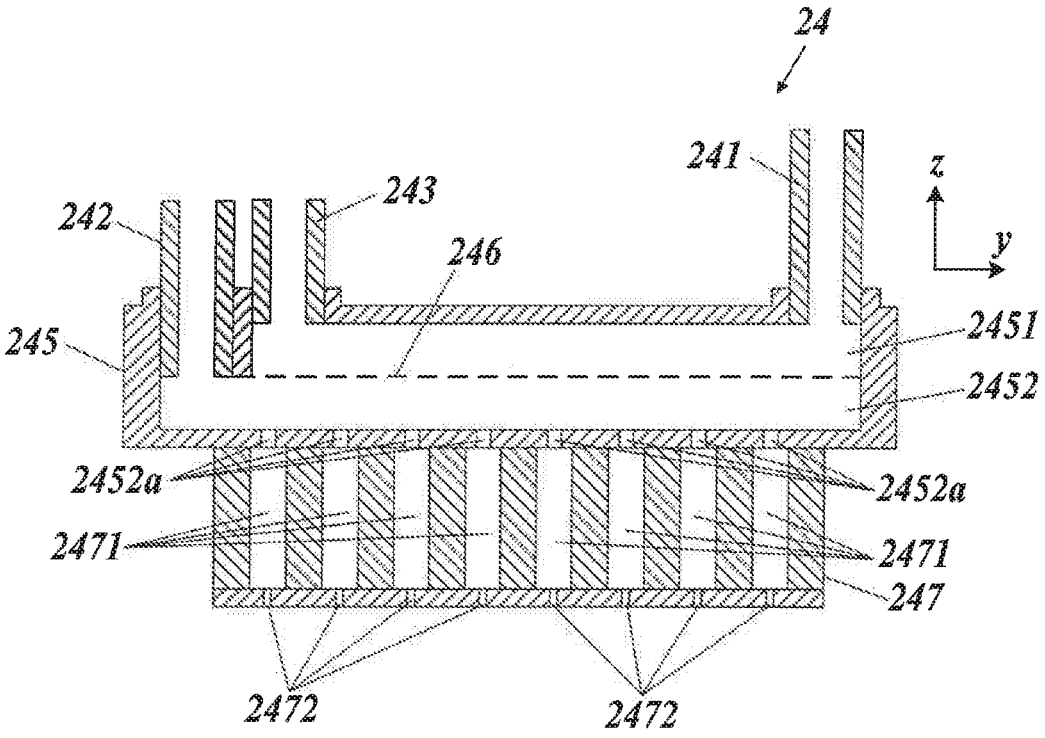
FIG. 3 is a cross-sectional view of an ink flow path in an inkjet head from the front side.

FIG. 3 is a cross-sectional view of the ink flow path in an inkjet head 24 from the front side.

The plurality of inkjet heads 24 attached to the head unit 282 are oriented as in this front view when viewed from the conveying direction.

The ink flow path in the inkjet head 24 includes a common ink chamber 245 (common flow path) to which the inlet 241 and the outlets 242 and 243 are connected, and an ink ejector 247 (a head chip) for ejecting ink from each nozzle.

The ink flowing in from the inlet 241 is fed to the common ink chamber 245. In the common ink chamber 245, there is provided a filter 246 with one side (the upstream ink chamber 2451) of which the inlet 241 communicates. The outlet 243 (second discharge port) is provided on the same side as the inlet 241 (upstream ink chamber 2451) with respect to the filter 246. Further, the outlet 242 (first discharge port) is provided on the side opposite to the inlet 241 (downstream ink chamber 2452). The filter 246 is interposed between the inlet 241 and the outlet 242.

The filter 246 prevents passage of contaminants through the ink. Further, the filter 246 suppresses passage of bubbles. In the inkjet recording device 100, the inkjet head 24 is provided such that the filter 246 is substantially horizontal. As a result, when air bubbles flow in from the inlet 241, they normally gather at the ceiling side of the upstream ink chamber 2451, and do not easily come into contact with the filter 246 or pass through the filter 246. Through holes 2452*a* each communicating with a nozzle of the ink ejector 247 are provided on the bottom surface of the downstream ink chamber 2452.

The ink ejector 247 includes a plurality of individual flow paths 2471 and nozzles 2472 respectively corresponding to the plurality of individual flow paths 2471, and ejects ink from openings of these nozzles 2472. The positions of the attached individual flow paths 2471 are the same as the positions of the through holes 2452*a* of the downstream ink chamber 2452. The ink in the common ink chamber 245 is distributed to the respective nozzles 2472.

The openings of the plurality of nozzles 2472 are provided on the nozzle surface of each inkjet head 24 at a predetermined interval (pitch) in the width direction. The arrangement pattern of the nozzle openings is not particularly limited, and may be a simple one-dimensional arrangement, a staggered lattice arrangement having a plurality of rows in the conveying direction, or the like. It is preferable that the nozzle openings provided in each of the inkjet heads 24 whose positions in the width direction are adjacent to each other partially overlap with each other in the width direction, so that ink is reliably ejected over the entire width of the recording medium.

An actuator (not shown) such as a piezoelectric element is provided in contact with a wall surface of the individual flow path 2471. The ink droplets are ejected from the openings of the nozzles 2472 at an appropriate liquid amount, droplet shape, and speed, by changing the pressure of ink in the individual flow path 2471 by an operation (driving operation) of the actuator according to a drive signal output from a head driver 54 (see FIG. 4).

The drive signal to be used is not particularly limited, and may have a voltage waveform (waveform for ejection) including successive trapezoidal waveforms each representing output of the lower voltage side (negative voltage side) and output of higher voltage side, with respect to the reference voltage (such as ground voltage). Here, when the higher voltage is applied, the actuator compresses the individual flow path 2471 (pressure chamber) and raises the ink pressure. When the lower voltage is applied, the actuator expands the individual flow path 2471 and decreases the ink pressure. That is, the actuator once lowers the ink pressure in order to draw the ink to the back side of the nozzle, and then raises the ink pressure to eject the ink from the nozzle (an ejection driving operation). In addition, the head driver 54 outputs a driving voltage pattern having a minute vibration waveform in which potential differences (that is, amplitudes) from the reference voltage to the high voltage and to the low voltage are smaller than those at the time of ink ejection, thereby reducing the pressure variation of the ink. This enables a minute driving operation for vibrating ink in the nozzle without actually ejecting the ink from the nozzle. This prevents thickening of ink due to evaporation or the like near the nozzle opening by stirring the ink in the nozzle when ink is not ejected for a predetermined time or more.

Figure 4:
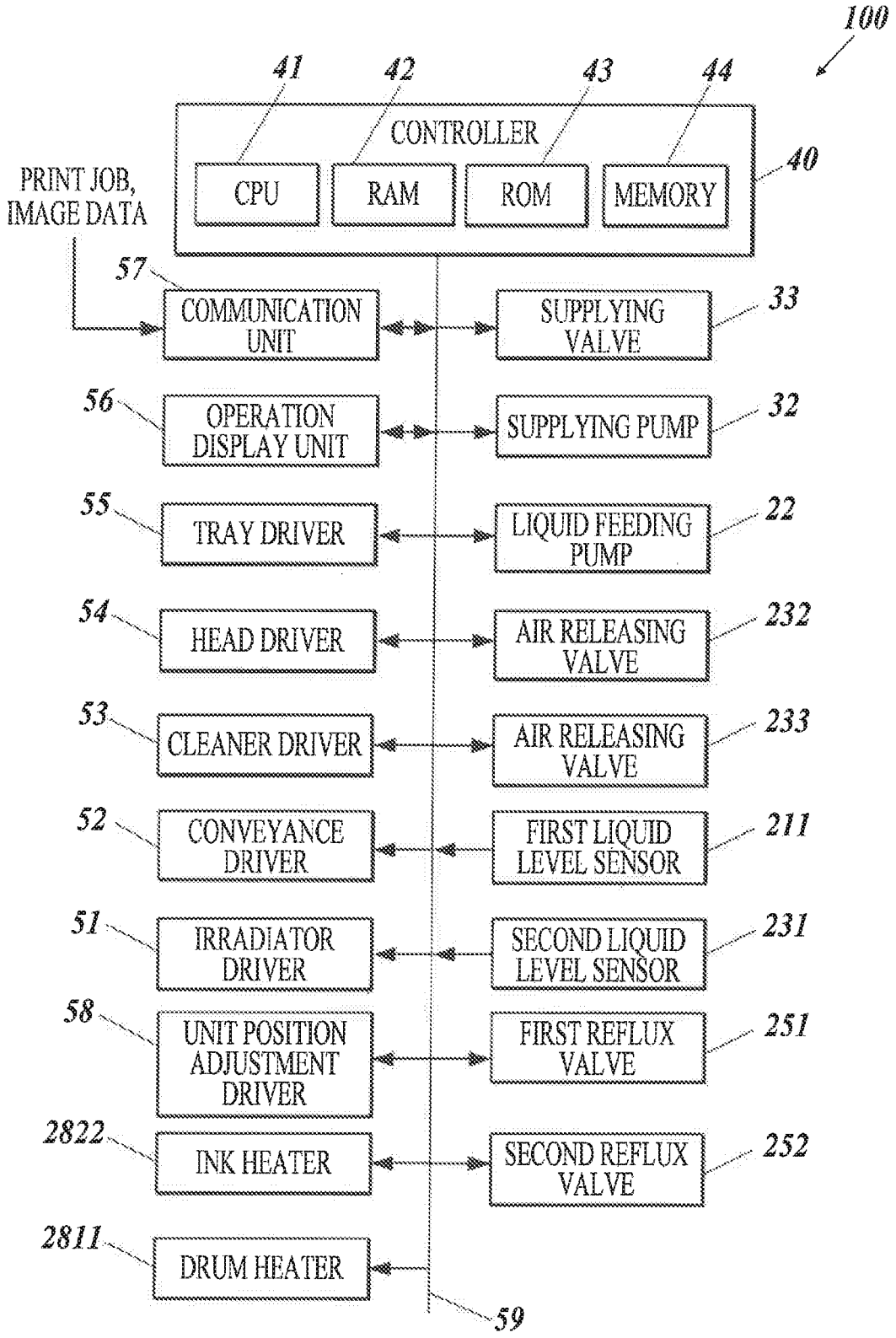
FIG. 4 is a block diagram showing functional components of the inkjet recording device.

FIG. 4 is a block diagram showing a functional configuration of the inkjet recording apparatus 100 according to the present embodiment.

As described above, the inkjet recording device 100 includes the supplying pump 32, the supplying valve 33, the liquid feeding pump 22, the first liquid level sensor 211, the second liquid level sensor 231, the air releasing valves 232 and 233, the first reflux valve 251, the second reflux valve 252, the drum heater 2811, and the like. Also, the inkjet recording device 100 includes the controller 40, the unit position adjustment driver 58, the ink heater 2822, a conveyance driver 52, a cleaner driver 53, the head driver 54 (driving unit), a tray driver 55, the irradiator driver 51, an operation display unit 56, a communication unit 57, a bus 59, and the like.

The controller 40 comprehensively controls the inkjet printing apparatus 100 and includes a central processing unit (CPU) 41, a random access memory (RAM) device 42, ROM (Read Only Memory) 43, and a memory 44.

The CPU 41 performs various calculations to control conveyance of a recording medium, ejection of ink, the maintenance operation, and the like in the inkjet recording device 100. This maintenance operation includes bubble discharge process for discharging air bubbles in the ink flow path. Further, the CPU 41 performs various processes regarding image recording based on image data, a status signal and a clock signal of each part, and the like according to the programs which are read out from the ROM 43.

The RAM 42 provides a working memory space for the CPU 41 and stores temporary data.

The ROM 43 stores control programs and initial setting information. The control programs include programs regarding the bubble discharge process described above. The ROM 43 includes an overwritable updatable nonvolatile memory to store data which is set and maintained at any time, such as setting data. The memory 44 includes a RAM for temporarily storing the image data to be recorded.

The conveyance driver 52 generates and outputs a drive signal for respectively rotating, in an appropriate direction and rate, the motors such as a rotary motor of the image forming drum 281, a motor for rotating each of the feeder board 12 and the second delivery unit 29. The conveyance driver 52 outputs the drive signal according to the rotation direction and the rotation rate of each of these motors on the basis of the control signal from the controller 40.

The cleaner driver 53 causes a wiper and the like (not shown) to perform wiping and removing operations of ink and ink mist adhering to the nozzle surface and the like. A winding type nonwoven fabric, a sponge material, a blade member, or the like can be used as the wiper depending on the shape and material of the nozzle surface. The cleaner driver 53 may have a configuration for applying a cleaning liquid to these wipers. The cleaner driver 53 may further have a configuration of wiping the nozzle surface and the like using a cleaning liquid and further wiping the cleaning liquid with a dried nonwoven fabric or the like.

The head driver 54 generates and outputs a drive voltage signal for deforming the pressure chamber (piezoelectric element) (for performing the driving operation) so that the ink ejector 247 ejects ink properly. Under the control signal from the controller 40, the head driver 54 selects a voltage waveform pattern stored in advance and generates the drive voltage signal which is amplified in power, and switches according to the image data input from the memory 44 whether or not the drive voltage signal for each piezoelectric element can be output.

The wires related to the head driver 54 may be collectively formed together with the ink flow path inside the inkjet head 24 or may be formed separately in part.

In accordance with the control signal from the controller 40, the irradiator driver 51 applies a predetermined voltage to the LED of the irradiator 283 for supplying an electric current, and causes the LED to emit ultraviolet rays.

The unit position adjustment driver 58 outputs the drive signal to the motor and/or the brake for position adjustment in accordance with a control signal from the controller 40, so that the head unit 282 is moved to a desired position and fixed.

The tray driver 55 moves the ink tray 261 according to a control signal from the controller 40. Various well-known techniques such as a gear train and an actuator driven by a motor can be used for the movement operation of the ink tray 261. In this case, the positional relationship between the ink tray 261 and the head unit 282 (inkjet head 24) need not to be strictly determined as in image recording, as long as ink ejected from the inkjet head 24 does not come off the ink tray 261. Further, there may be provided a collision prevention mechanism, or the controller 40 may perform collision prevention control, so that the ink tray 261 does not move to a position facing the inkjet head 24 as long as the head unit 282 is not separated from the conveying surface by a predetermined height or more, and/or so that the head unit 282 does not approach within a predetermined height from the conveying surface as long as the ink tray 261 is not retracted.

The ink heater 2822 heats the ejected ink and keeps it at an appropriate temperature in the head unit 282, thereby maintaining the viscosity and the like of the ink in an appropriate state. If a type of ink which becomes a gel at room temperature or low temperature is used, the ink heater 2822 has a configuration to heat the ink in the entire ink flow path described above. The temperature of the ink is estimated from the temperature measured by a thermometer (not shown) near the nozzle of the inkjet head 24. The operation state of the ink heater 2822 is controlled on the basis of the temperature of the ink.

The communication unit 57 is a communication interface for controlling a communication operation with an external device. The communication interface includes one or more communication interfaces (e.g. a LAN board and a LAN card) corresponding to various communication protocols. The communication unit 57 may acquire image data to be recorded and setting data (job data) image recording from an external device under the control of the controller 40, and may transmit the status information and the like to the external device.

The operation display unit 56 displays the status of the inkjet recording device 100, an operation menu, and the like according to the control signal from the controller 40, accepts user's operation, and outputs the received operation to the controller 40. The operation display unit 56 includes a liquid crystal display unit on which a touch sensor is provided as operation accepting means, for example. The controller 40 causes the liquid crystal display unit to display statuses and various menus for accepting commands via the touch sensor. The controller 40 performs a control operation to cause each part of the inkjet recording device 100 to perform a process corresponding to the user's touch operation detected by the touch sensor and information on content and/or position of the displayed menu. The controller 40 performs a control operation for causing each part of the inkjet recording device 100 to perform processes depending on the information on the content and position of the displayed menu and the user's touch operation detected by the touch sensor.

The bus 59 is a path for connecting the above components electrically and exchanging signals between them.

In addition to these configurations, the inkjet recording device 100 may include a notification unit such as an LED lamp and/or a beep sound generator used for a notification operation, a reading unit such as a line sensor for detecting an image quality abnormality (defect) of an image formed on a recording medium and a placement abnormality detection sensor for detecting that the supplied recording medium is not normally placed on the conveying surface.

Next, a bubble discharging operation in the inkjet recording device 100 of the present embodiment will be described.

In the inkjet recording device 100 according to the present embodiment, a bubble discharging process (bubble discharging operation) is performed at the time of filling (refilling) the ink flow path with ink or during maintenance when a predetermined recording failure is detected in image recording. This bubble discharging process can be automatically executed in conjunction with the above-described conditions. Alternatively, the bubble discharging process may be started on the basis of a predetermined input operation via the operation display 56 by the user.

In the inkjet recording device 100, air bubbles in the common ink chamber 245 are discharged from the common ink chamber 245 to the first sub tank 21 in the bubble discharging process, by operating the liquid feeding pump 22 to return the ink in the common ink chamber 245 to the first sub tank 21 while the first reflux valve 251 (and the second reflux valve 252, if necessary) is opened. Further, at the same time, ink is allowed to leak out from the nozzle opening portion in parallel to discharge bubbles entering the nozzle from the nozzle opening portion by a small pressure variation of the ink in individual flow paths 2471 depending on the drive voltage pattern of minute vibration waveform and applying the ink pressure by the liquid feeding operation by the liquid feeding pump 22. The ink pressure at this time needs to be a pressure at which ink reliably leaks from all the nozzles. The ink pressure may be set to a level at which ink leaks continuously from all the nozzles regardless of the phase of the drive voltage pattern of the minute vibration waveform or the like.

Figure 5:
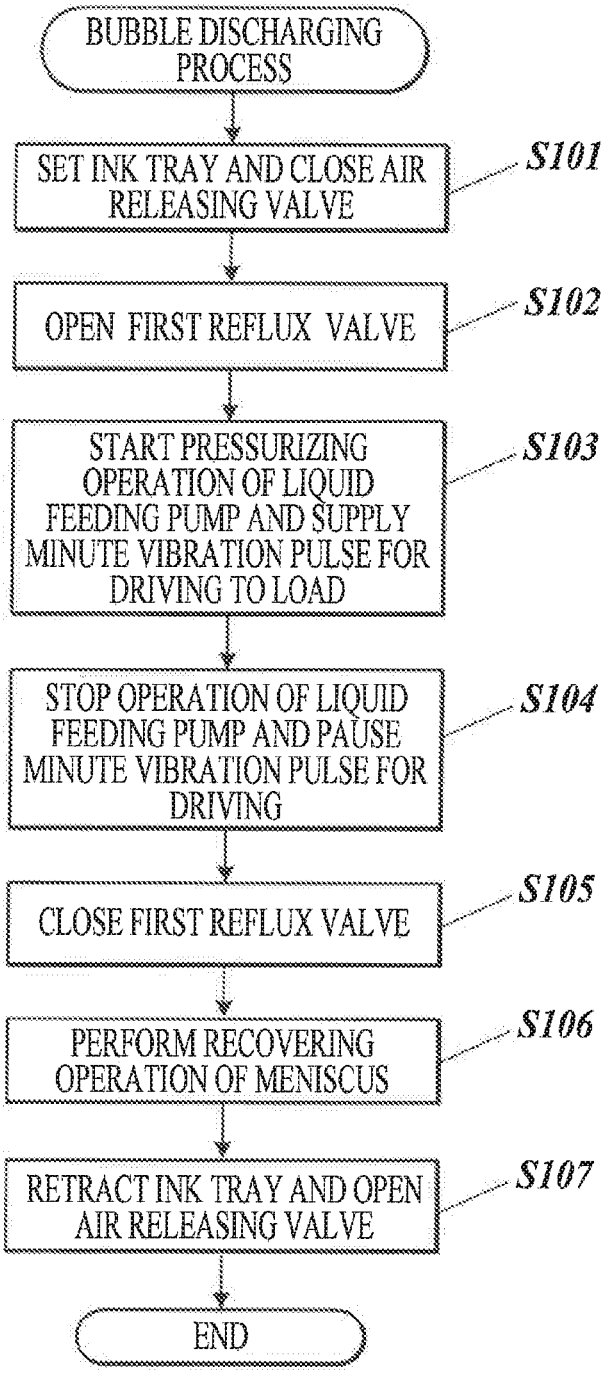
FIG. 5 is a flowchart of control procedure of bubble discharging process.

FIG. 5 is a flowchart showing a control procedure by the controller 40 in the bubble discharging process executed in the inkjet recording device 100.

When the bubble discharging process is started, the controller 40 (CPU 41) outputs a control signal to the unit position adjustment driver 58 as needed to increase the distance from the conveying surface of the head unit 282 and outputs a control signal to the tray driver 55 so that the ink tray 261 faces the nozzle surface. In addition, the controller 40 causes the air releasing valve 233 to be closed and the second sub tank 23 to be disconnected from the air tank 234 (step S101).

The controller 40 causes the first reflux valve 251 to be opened so that the downstream ink chamber 2452 communicates with the first sub tank 21 (step S102). At this time, the controller 40 may cause the second reflux valve 252 to be opened. The controller 40 causes the liquid feeding pump 22 to perform pressurizing and feeding of ink so that pressurization supply of ink to the inkjet head 24 starts via the second sub tank 23. Further, the controller 40 outputs a control signal to the head driver 54 so as to cause the actuator corresponding to each individual flow path 2471 to output a driving voltage signal related to the minute vibration waveform (step S103) and to perform a driving operation (a minute driving operation). There is no problem even if the pressurization supply of ink and the output of the driving voltage signal start at slightly different timings, however, it is preferred that they are performed basically at the same time.

After a predetermined time has elapsed, the controller 40 causes the liquid feeding pump 22 to stop the operation and causes output of the driving voltage of the minute vibration waveform to be paused (step S104). The controller 40 causes the first reflux valve 251 to be closed (step S105). When the second reflux valve 252 is opened, the controller 40 also causes the second reflux valve 252 to be closed.

The controller 40 performs an operation to recover the ink level (meniscus) in the nozzle 2472 as necessary (step S106). The controller 40 outputs a control signal to the head driver 54 to output a waveform for ejection, and causes each nozzle to eject ink.

The controller 40 causes the ink tray 261 to be retracted from the nozzle surface and the air releasing valve 233 of the second sub tank 23 to opened (step S107). In addition, at this time, the controller 40 can output a control signal to the cleaner driver 53 for performing a cleaning operation of nozzle surface and the like. Then, the controller 40 finishes the bubble discharge process.

Modified Example

Figure 6A:
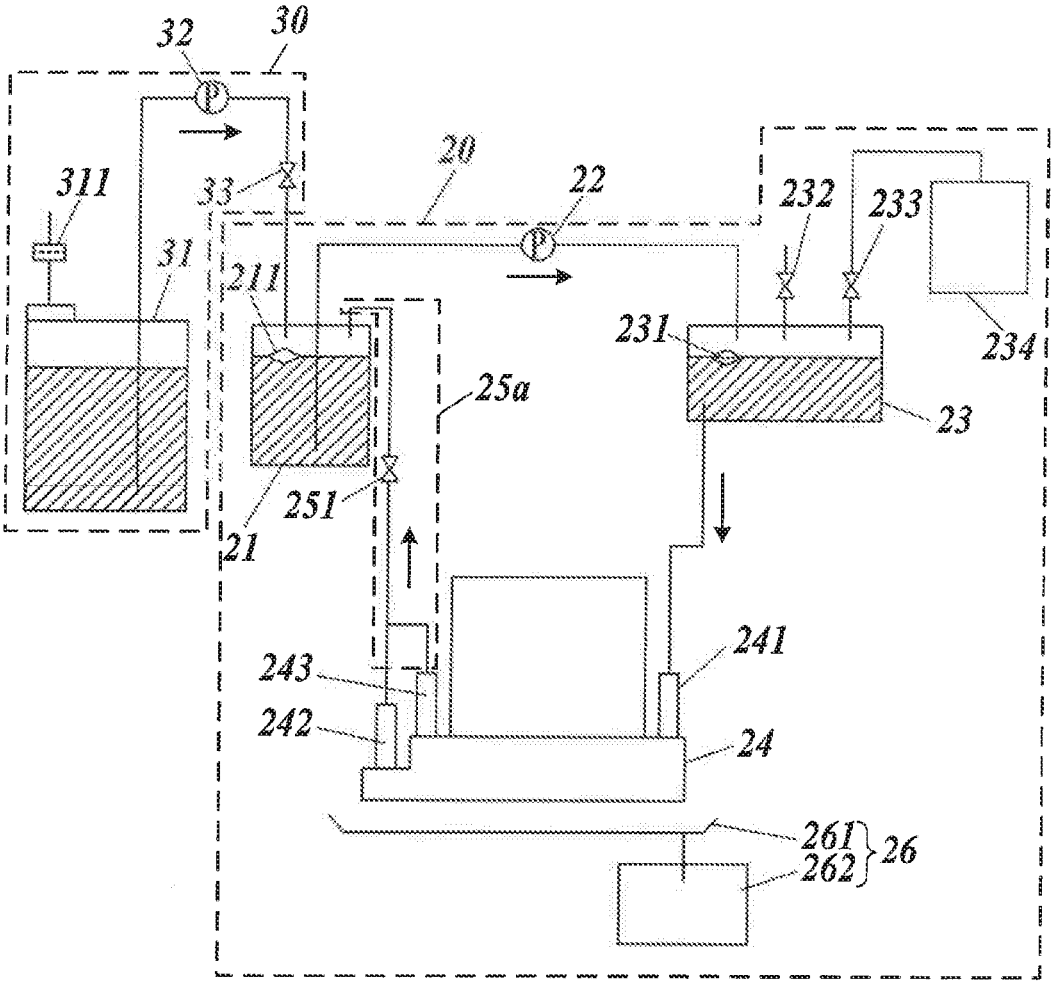
FIG. 6A is a diagram showing a modified example of the inkjet recording device.
Figure 6B:
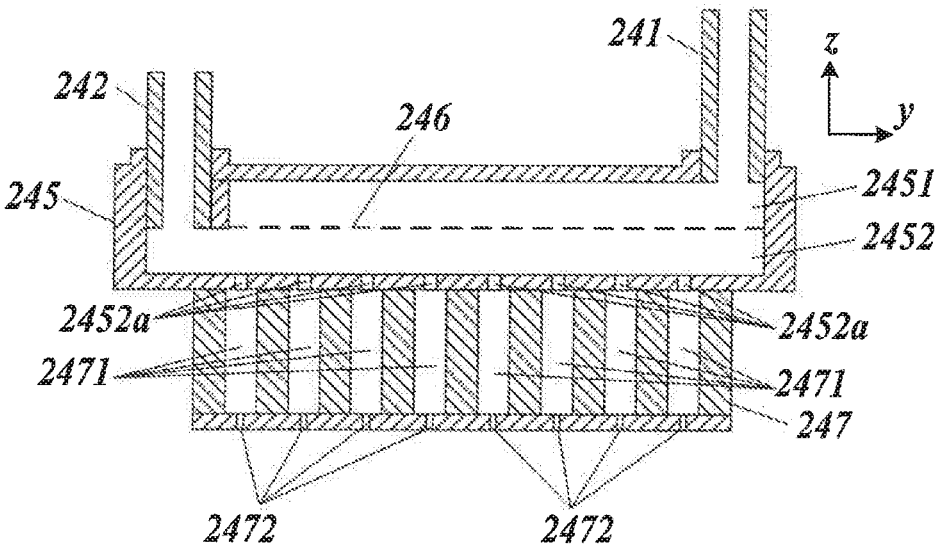
FIG. 6B is a diagram showing a modified example of the inkjet recording device.

FIGS. 6A and 6B are diagrams showing modified examples of the inkjet recording device 100 of the present embodiment.

As shown in FIG. 6A, in the reflux unit 25*a*, the circulation flow paths communicating with the outlets 242 and 243 may be joined and connected to the first sub tank 21 via the first reflux valve 251. In this case, so that ink does not flow from the outlet 243 to the outlet 242, the flow path resistance at the connected portion is sufficiently larger than the flow path resistance of the filter 246.

Further, as shown in FIG. 6B, the outlet 243 for discharging ink from the upstream ink chamber 2451 may not be provided. In this case, the ink necessarily passes through the filter 246 and then is ejected (or leaks) from the nozzles 2472 or is discharged from the outlet 242.

As described above, the inkjet recording device 100 according to the present embodiment includes the inkjet head 24 provided with the nozzles 2472 for ejecting ink, the liquid feeding pump 22 for supplying ink to the inkjet head 24, the head driver 54 for performing a driving operation to cause a pressure variation regarding ejection of ink in the nozzles, and the controller 40 for controlling the operation of the liquid feeding pump 22 and the head driver 54. The inkjet head 24 includes the common ink chamber 245 in which ink supplied to the inkjet head 24 flows, a filter 246 provided in the common ink chamber 245 for passing the supplied ink, the individual flow paths 2471 for feeding the ink having passed through the filter 246 in the common ink chamber 245 to each of the nozzles 2472. In the bubble discharging operation of the ink in the inkjet head 24 the controller 40 causes the liquid feeding pump 22 to supply ink with the pressure at which ink leaks from the nozzles 2472, while causing the head driver 54 to perform the predetermined driving operation, and causes the ink to be discharged from the outlet 242.

Thus, in the bubble discharging operation, the bubbles can be easily and collectively discharged from various portions in the ink flow path of the inkjet head 24 in a single operation by causing the liquid feeding pump 22 to perform the liquid feeding operations simultaneously: the operation for leaking ink in the individual flow paths 2471 and the nozzles 2472 from the nozzles 2472; and the operation for leaking ink in the common ink chamber 245 from the outlet 242. Further, by applying a driving voltage with a predetermined driving waveform pattern to the actuator at this time, air bubbles on the wall surfaces of the individual flow paths 2471 and the nozzles 2472 are effectively detached, and can be discharged from the nozzle openings effectively and reliably.

The inkjet recording device 100 according to the present embodiment includes a first sub tank 21 which stores ink to be supplied to the common ink chamber 245, and a reflux unit 25 which returns ink discharged from the outlet 242 to the first sub tank 21. As a result, most of the ink fed by the liquid feeding pump 22 for discharging air bubbles can be returned to the first sub tank 21 to be reused, so that the amount of wasted ink can be reduced.

The inkjet recording device 100 of the present embodiment is provided with a first reflux valve 251 for switching whether to discharge ink from the outlet 242. The controller 40 causes the first reflux valve 251 to be closed when performing a normal ejection operation related to image recording, and causes the first reflux valve 251 to be opened when performing the bubble discharging operation.

As a result, it is possible to appropriately control and adjust the ink flow and the ink pressure in the inkjet head 24.

The inkjet recording device 100 of the present embodiment is further provided with an outlet 243 for discharging ink not having passed through the filter 246 and being in the common ink chamber 245. The controller 40 causes the supplied ink to be discharged from at least the outlet 242 when executing the bubble discharging operation.

That is, if necessary, it is possible to discharge ink, that is, air bubbles and the like, from the inkjet head 24 without passing through the filter 246 and to promptly discharge large bubbles and the like without passing through the filter 246. It is possible to appropriately select whether or not to perform the discharge from the outlet 243.

The inkjet recording device 100 of the present embodiment is provided with a second reflux valve 252 for switching whether to perform the discharge from the outlet 243. Since the controller 40 causes the second reflux valve 252 to be closed when executing a normal ejection operation related to at least image recording, it is possible to appropriately control and adjust the ink flow and the ink pressure in the inkjet head 24.

In the bubble discharging operation, the controller 40 causes the head driver 54 to perform a minute driving operation for causing a pressure variation which does not allow ink to be ejected from the nozzles 2472 during the image recording operation.

By using the minute driving waveform as described above, it is possible to prevent ink from ejecting from the nozzles more than necessary. In addition, by pressurizing the pressurized ink further according to the operation of the liquid feeding pump 22, it is possible to prevent excessive increase of ejection pressure. As a result, generation of unnecessary mist and the like can be suppressed. In addition, by using the same driving waveform as usually used, it is not necessary to increase the type of driving waveform to be held and output, and the driving operation can be simplified.

It should be noted that the present invention is not limited to the above embodiment, and various modifications are possible.

For example, in the bubble discharging process of the above embodiment, the actuator is driven with the normal driving voltage pattern having a minute vibration waveform, but the present invention is not limited thereto. The actuator may be driven with a voltage of the waveform for ejection, or with a drive voltage pattern having a vibration frequency different from the normal drive waveform, for example, at a vibration frequency lower than that of a drive waveform which is output normally, so that power consumption can be reduced.

In the above embodiment, the inkjet head 24 is attached such that the filter 246 is substantially horizontal, but the present invention is not limited thereto. For example, the filter 246 may be obliquely inclined toward the outlets 242 and 243. In this case, air bubbles in the upstream ink chamber 2451 and the downstream ink chamber 2452 easily move toward the outlets 242, 243 by buoyant force only.

In addition, the waveform for ejection and the minute vibration waveform may not be trapezoidal waveforms but rectangular waveforms or combinations thereof. When vibrations of multiple amplitudes or waveforms are combined, the waveform pattern for discharging bubbles may be different from normal waveforms for ejection and minute vibration waveform.

In the above embodiment, a piezo-type inkjet recording device in which ejection of ink and minute vibrations are performed with an actuator using a piezoelectric element has been described as an example, however, the actuator may be an element other than a piezoelectric element, for example, a magnetostrictive element. Alternatively, the present invention can be similarly applied to a thermal-type inkjet recording device.

Further, ink leaks to the ink tray 261 in the above embodiment, however, a sponge material which absorbs ink or simply a recording medium may be used.

Further, the operation to recover the meniscus need not to be performed in combination with the bubble discharging process, but may be performed only at the start of normal image recording as needed.

Further, the liquid feeding pump 22 is capable of pressurizing and supplying ink to the inkjet head 24 via the second sub tank 23 in the above embodiment, however, other configurations may be adopted. For example, when ink is pressurized and fed to the inkjet head 24, a flow path bypassing the second sub tank 23 may be used.

Further, a one-pass type inkjet recording device including a line head is described as an example in the above embodiment, however, a scan type inkjet recording device ejecting ink onto a recording medium while moving the inkjet head, a multipass type inkjet recording device, or the like may be used.

According to the present invention, there is an effect of being able to discharge air bubbles in ink flow path more easily and reliably in an inkjet recording device.

In addition, specific details such as the configuration, arrangement, procedure of control operations, and the like shown in the above embodiment can be appropriately changed without departing from the spirit of the present invention.

Although embodiments of the present invention have been described and illustrated in detail, the disclosed embodiments are made for purposes of illustration and example only and not limitation. The scope of the present invention should be interpreted by terms of the appended claims.

INDUSTRIAL APPLICABILITY

The present invention is applicable to inkjet recording devices.

REFERENCE SIGNS LIST

10 Medium Supplier
11 Paper Feeding Tray
12 Feeder Board
121, 122 Roller
123 Belt
15 Medium Receiving Unit
16 Copy Receiving Tray
20 Image Forming Body
21 First Sub Tank
211 First Liquid Level Sensor
22 Liquid Feeding Pump
23 Second Sub Tank
231 Second Liquid Level Sensor
232, 233 Air Releasing Valve
234 Air Tank
24 Inkjet Head
241 Inlet
242, 243 Outlet
245 Common Ink Chamber
2451 Upstream Ink Chamber
2452 Downstream Ink Chamber
2452*a* Through Hole
246 Filter

247 Ink Ejector
2471 Individual Flow Path
2472 Nozzle
25, 25*a* Reflux Unit
251 First Reflux Valve
252 Second Reflux Valve
26 Ink Receiving Unit
261 Ink Tray
262 Waste Liquid Tank
27 First Delivery Unit
271 Swing Arm
272 Reception Drum
281 Image Forming Drum
2811 Drum Heater
282 Head Unit
2822 Ink Heater
283 Irradiator
283*a* Light Shielding Plate
29 Second Delivery Unit
291 Delivery Roller
292, 293 Roller
294 Belt
30 Ink Supplier
31 Main Tank
311 Filter
32 Supplying Pump
33 Supplying Valve
40 Controller
41 CPU
42 RAM
43 ROM
44 Memory
51 Irradiator Driver
52 Conveyance Driver
53 Cleaner Driver
54 Head Driver
55 Tray Driver
56 Operation Display Unit
57 Communication Unit
58 Unit Position Adjustment Driver
59 Bus
100 Inkjet Recording Device

The invention claimed is:

1. An inkjet recording device comprising:
an inkjet head which is provided with one or more nozzles which perform ejection of ink;
an ink supplier which supplies ink to the inkjet head;
a driver which performs a driving operation to cause a pressure variation of ink in the nozzles regarding the ejection; and
a controller which controls an operation of the ink supplier and an operation of the driver,
wherein the inkjet head comprises:
a common flow path in which supplied ink to the inkjet head flows;
a filter which is provided in the common flow path and through which supplied ink passes;
one or more individual flow paths which respectively feed ink having passed through the filter from the common flow path to each of the nozzles; and
a first discharge port from which ink having passed through the filter and being in the common flow path is discharged;
wherein, in a bubble discharging operation of ink in the inkjet head, the controller causes the ink supplier to supply ink with a pressure which allows ink to leak out from the nozzles while the controller causes the driver to perform a predetermined driving operation, so that ink is discharged from the first discharge port.

2. The inkjet recording device according to claim 1, comprising:
an ink storage which stores ink to be supplied to the common flow path; and
a circulation flow path through which ink discharged from the first discharge port returns to the ink storage.

3. The inkjet recording device according to claim 1, comprising:
a first discharge valve which switches whether or not discharge is performed from the first discharge port,
wherein the controller causes the first discharge valve to be closed in a normal ejection operation for image recording, and causes the first discharge valve to be opened in the discharging operation.

4. The inkjet recording device according to any claim 1, comprising:
a second discharge port from which ink not having passed through the filter and being in the common flow path is discharged,
wherein, in the bubble discharging operation, the controller causes supplied ink to be discharged at least from the first discharge port.

5. The inkjet recording device according to claim 4, comprising:
a second discharge valve which switches whether or not discharge is performed from the second discharge port,
wherein the controller causes the second discharge valve to be closed at least in a normal ejection operation for image recording.

6. The inkjet recording device according to claim 1,
wherein, in the bubble discharging operation, the controller causes the driver to perform a minute driving operation to cause the pressure variation which does not allow ink to be ejected from the nozzles during an image recording operation.

* * * * *